US005396974A

United States Patent [19]

Pedlar

[11] Patent Number: 5,396,974

[45] Date of Patent: Mar. 14, 1995

[54] LUGGAGE CASE

[75] Inventor: Roger Pedlar, London, England

[73] Assignee: Samsonite Corporation, Denver, Colo.

[21] Appl. No.: 24,116

[22] Filed: Feb. 25, 1993

[30] Foreign Application Priority Data

Feb. 26, 1992 [GB] United Kingdom ..... 9204138

[51] Int. Cl.[6] ..... A45C 5/14

[52] U.S. Cl. ..... 190/18 A; 16/30; 280/37

[58] Field of Search ..... 16/30; 280/37; 190/18 A, 116, 117, 36

[56] References Cited

U.S. PATENT DOCUMENTS

| | | |
|---|---|---|
| Re. 29,036 | 11/1976 | Hager . |
| 322,239 | 7/1885 | Beckwith . |
| D. 339,917 | 10/1993 | Pedlar . |
| 1,030,801 | 6/1912 | Berault . |
| 1,054,907 | 3/1913 | Cowan . |
| 1,263,688 | 4/1918 | Lombardo . |

(List continued on next page.)

FOREIGN PATENT DOCUMENTS

| | | |
|---|---|---|
| 47945 | 4/1974 | Australia . |
| 79395 | 11/1981 | European Pat. Off. . |
| 157968 | 10/1985 | European Pat. Off. . |
| 247321 | 3/1987 | European Pat. Off. . |
| 336802 | 4/1988 | European Pat. Off. . |
| 319793 | 6/1989 | European Pat. Off. . |
| 572508 | 6/1990 | European Pat. Off. . |
| 650890 | 5/1928 | France . |
| 1240325 | 7/1960 | France ..... 190/18 A |
| 1433227 | 5/1965 | France . |
| 2455442 | 5/1979 | France . |
| 2521840 | 2/1982 | France . |
| 447315 | 7/1927 | Germany . |
| 175514 | 7/1953 | Germany . |
| 2212232 | 3/1972 | Germany . |
| 2213582 | 3/1972 | Germany . |
| 2461698 | 12/1974 | Germany . |
| 2331837 | 1/1975 | Germany . |
| 587630 | 5/1977 | Switzerland . |
| 24086 | 11/1908 | United Kingdom . |
| 212352 | 3/1924 | United Kingdom . |
| 471981 | 9/1937 | United Kingdom . |
| 961639 | 6/1964 | United Kingdom . |
| 1363753 | 8/1974 | United Kingdom . |
| 1576372 | 10/1980 | United Kingdom . |
| 2164993 | 4/1986 | United Kingdom . |
| 2214490 | 6/1989 | United Kingdom . |

*Primary Examiner*—Allan N. Shoap
*Assistant Examiner*—Christopher J. McDonald
*Attorney, Agent, or Firm*—Gregory W. O'Connor

[57] ABSTRACT

Luggage cases, especially if they are large and bulky, usually have wheels and glides or legs to hold the case upright when loaded and permit the case to be pulled or wheeled. These same large cases present a large volume—an advantage when actually being used to carry clothing. However, this large volume is a disadvantage during packaging, storage and shipping after manufacture, such as between the factory and the store where it is sold. This large volume is a disadvantage also when the case is being stored by the owner between trips. Shown here is a case (10) with easily removable wheels (11) and feet (13). These external fittings attach to the outside of the luggage shell and have a projection (92) which extends to an aperture (90) in the wall of the case shell to the inside of the case. A manually releasable latch (96), such as a clip, engages and disengages this projection from the inside of the case to mount the wheel and leg to the outside of the case. This attaching system also acts as an anchoring device (114) for the straps (116) normally used to hold and arrange clothing when packed inside the assembled case. This external fitment system is especially useful when the two shells (12) and (14) of the case are stored one within the other during shipping by the manufacturer and storage by the consumer.

16 Claims, 9 Drawing Sheets

U.S. PATENT DOCUMENTS 1,559,898 11/1925 Lotz .
1,653,015 12/1927 Koelln .
1,817,518 8/1931 Lacher .
1,864,551 6/1932 Poeter .
1,875,037 8/1932 Leberman .
1,878,413 9/1932 Leberman .
2,041,850 5/1936 Melick .
2,416,783 3/1947 Vallieres .
2,611,463 9/1952 Trimble .
2,766,901 9/1953 Sunko .
2,875,868 3/1959 Powell .
2,885,070 5/1959 Ondrejka .
2,886,830 5/1959 Iaquinta .
3,010,552 11/1961 Davidson .
3,161,271 12/1964 O'Neil .
3,166,367 1/1965 Vincens .
3,371,757 3/1968 Jamison et al. .
3,463,531 8/1969 Reynaud .
3,579,804 5/1971 Slan .
3,605,961 9/1971 Marrion .
3,710,901 1/1973 Guard .
3,799,568 3/1974 Hager .
3,949,445 4/1976 Stevens .
4,026,570 5/1977 Feinberg .
4,299,313 11/1981 Null .
4,311,222 1/1982 Castanier .
4,335,896 6/1982 Koffler .
4,422,212 12/1983 Sheiman et al. ..... 16/30 X
4,448,292 5/1984 Comfort .
4,463,840 8/1984 Seynhaeve ..... 190/18 A
4,503,955 3/1985 Fitzsimmons .
4,561,526 12/1985 Winter .
4,576,307 3/1986 Frydenberg .
4,589,530 5/1986 Sher ..... 190/18 A
4,693,346 9/1987 Eversdijk .
4,712,657 12/1987 Myers .
4,719,663 1/1988 Termini .
4,744,445 5/1988 Anderson .
4,838,396 6/1989 Krenzel .
4,838,585 6/1989 Jondrow .
4,874,209 10/1989 Spitzer et al. ..... 16/30 X
4,928,800 5/1990 Green .
5,197,579 3/1993 Bieber et al. ..... 190/18 A 60
64
66
62
68
70

18
82
90
102
80
86
84
92
94
88
96
106
108
98
100
104
110
114
116

112
180
192
184
194
182
188
196
186
188
108
100
108
96
114
156
100'
96'
98'

LUGGAGE CASE

The present invention relates to luggage cases and is particularly concerned with an arrangement for mounting external fittings such as, for example, wheels or other ground-engaging support means or carrying handles or pulling loops, on cases.

It is well known to provide a case with wheels or casters on its outsides on which the case can be trundled when heavily laden. It is also known to provide cases with feet to make the case more stable when stood on edge and to protect the shell of the case from scuffing. It is also well known to provide cases with carrying handles and pulling loops or handles.

The provision of such external fittings on the outside of the shell of a case does however give rise to a number of problems.

When the handles, loops, wheels or feet are assembled in the factory each item usually has to be assembled by hand with a tool such as a screwdriver to fix it in position.

The wheels or feet can cause problems for the user in stowing the case when not in use because they project from the outside of the shell of the case.

To assist the user in storing cases when not in use it has been proposed to produce a case which is formed of two shells, a base shell and a lid shell, which are joined together by a hinge pin which can be removed when the case is not in use so that the lid shell can be inverted and nested with the base shell to make the case more compact for storage. When provided with projecting wheels or feet or handles it may be necessary to remove the wheels or feet or handles before the shells can be nested.

There is thus a need for an arrangement for mounting a wheel or foot or handle to a shell whereby mounting or demounting can be achieved easily by unskilled users and without the use of tools.

According to the present invention there is provided a luggage case comprising two shells, hinged together, an external fitting, and retaining means, the external fitting including a mounting portion adapted to fit against a corresponding mounting portion of one of the shells, the mounting portion of the shell including an aperture through the wall of the shell, and the mounting portion of the ground-engaging means including a projection which extends through the aperture in the wall of the case to the inside, and the retaining means being releasably engageable with the part of the projection which is inside the shell to retain the mounting portion of the external fitting in position.

Preferably the case includes a strap for securing the luggage inside the case and the retaining means comprises means for anchoring the strap to the wall of the case. Thus the retaining means can be made to accomplish two separate functions: to hold the mounting for the external fitting in position and to provide anchorage for the strap that is used for holding garments or other contents in position when the case is in use. By eliminating the need for separate components to fulfill these functions simplification and a saving in the manufacturing costs is achieved.

When the case is one which is designed to be disassembled for storage, providing the retaining means as the anchorage for the straps has the additional advantage that the retaining means is atteched to the end of the strap and is threfore less likely to get lost when the fitting is disassembled.

Where the shells are moulded from plastics material, the aperture preferably has its axis perpendicular to the plane of the major wall of the case. In this way the aperture can be formed by the same moulding tool as the rest of the shell and there is no need for a separate insert in the moulding tool for forming the aperture. Furthermore, where a re-entrant portion is provided in the outside of the shell to receive the fitting or a recess is formed for receiving the mounting portion of the fitting they too are preferably aligned with the direction of movement of the moulding tools for the shell so as to present no significant undercuts. In this way the construction of the moulding tool is simplified and the costs and time taken in moulding the shells is reduced.

The retaining means preferably include resiliently mounted latching means for holding the retaining means in engagement with the projection. The latching means preferably include a detent, catch or pawl resiliently mounted on the retaining means.

The retaining means is preferably constructed so that as it is engaged with the projection it progressively pulls the mounting means of the external fitting into engagement with the shell of the case. To this end the retaining means may comprise a wedge-shaped portion which engages a slot in the projection.

The retaining means preferably is of a size and shape that it can easily be gripped in the hand and engaged with the projection without the use of tools.

The invention in another aspect provides a pack for constructing a self-assembly luggage case, the pack including a base shell and a lid shell for the case, and hinge means for connecting the base shell and the lid shell together when the case is assembled, the hinge means comprising a hinge pin for insertion into co-operating hinge butts on the shells when the case is assembled, the hinge pin including a pin portion and a transverse portion, the transverse portion being engageable with locating means on the shell to prevent axial movement of the hinge pin when the transverse portion is engaged with the locating means, and retaining means on the hinge means for co-operating with retaining means on the locking means to prevent accidental displacement of the transverse portion from the locking means.

The pack described in its preferred form is easy to assemble without the use of tools.

Embodiments of the invention will now be described by way of example with reference to the accompanying drawings in which.

The drawings show a suitcase 10 which is designed to be supplied with the shell halves, nested together and to be easily assembled by a person wishing to use the case. After use, the case can be dismantled for storage, and later reassembled for use.

Figure 1:
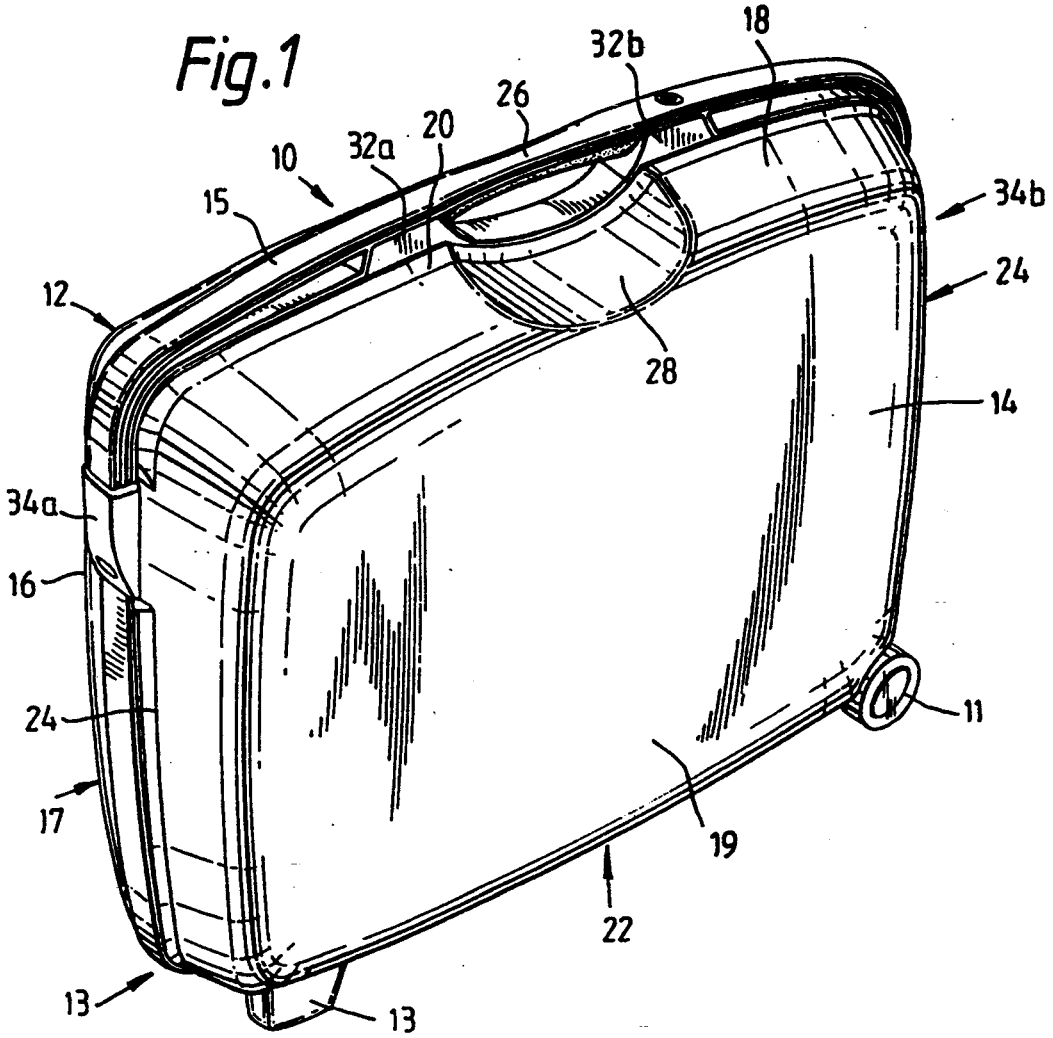
FIG. 1 shows a perspective view of a suitcase.

The suitcase 10 comprises two moulded plastics shells 12 and 14. One shell 12 constitutes a base shell, and the other shell 14 constitutes a lid shell. Each shell 12, 14 has a major side wall 17,19 and a peripheral wall 16,18, respectively. The peripheral walls 16 and 18 together form the top wall 20, bottom wall 22, and end walls 24 of the case, as shown in FIG. 1. The base shell 12 is formed with an integrally moulded handle strip 15 along the top wall of the case. A portion of the strip forms a carrying handle 26 which is spaced from the top wall 20 of the case by a short distance. An arcuate recess 28 is formed in the centre region of the top wall 20 under the carrying handle 26 to provide adaquate hand clearance for a person to grasp the handle to carry the case.

A pair of wheels 11 are attached to the bottom wall 22 of the case in a re-entrant portion of the shell at the corners between the bottom wall 22 and one of the end walls 24. A pair of feet 13 are attached to the bottom wall near the corners between the bottom wall 22 and the other end wall 24.

The shells 12 and 14 are hinged together along the bottom wall 22 of the case. Four slidable catches are provided for releasably fastening the shells together when the case is closed. Two catches **32*a* and 32*b* are located on the top wall 20 of the case, and two catches 34*a* and 34*b* are located one on each end wall 24. The ends of the strip 15 that forms the handle extend over the corners between the front wall 20 and the end walls 24 and are slidably attached to housings of the side catches 34*a* and 34*b***, to form flexible loop handles for pulling or pushing the case on its wheels.

Figure 2:
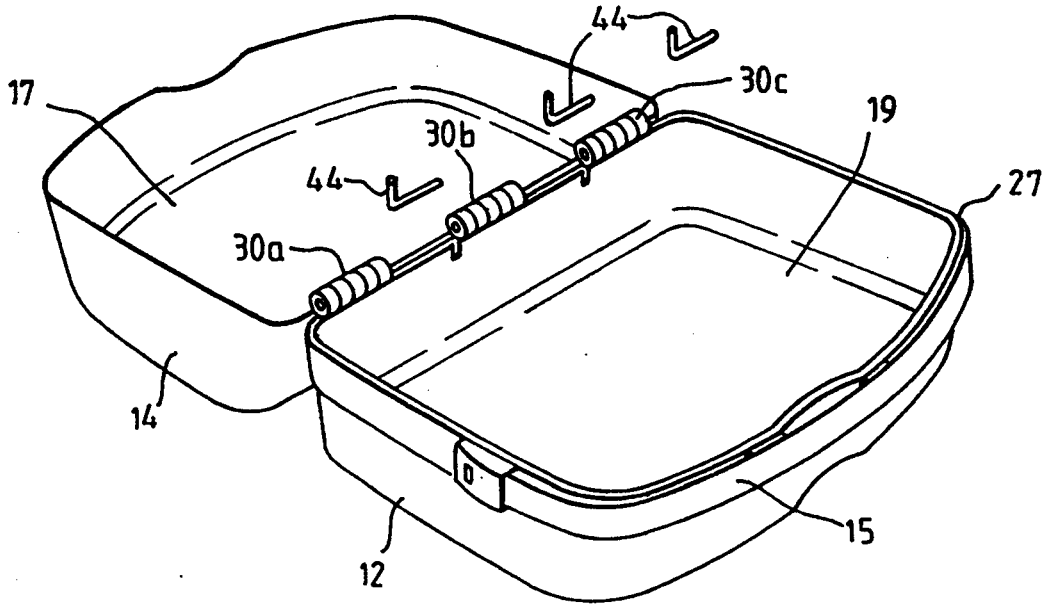
FIG. 2 shows a perspective view of the suitcase of FIG. 1 in an open condition.
Figure 3:
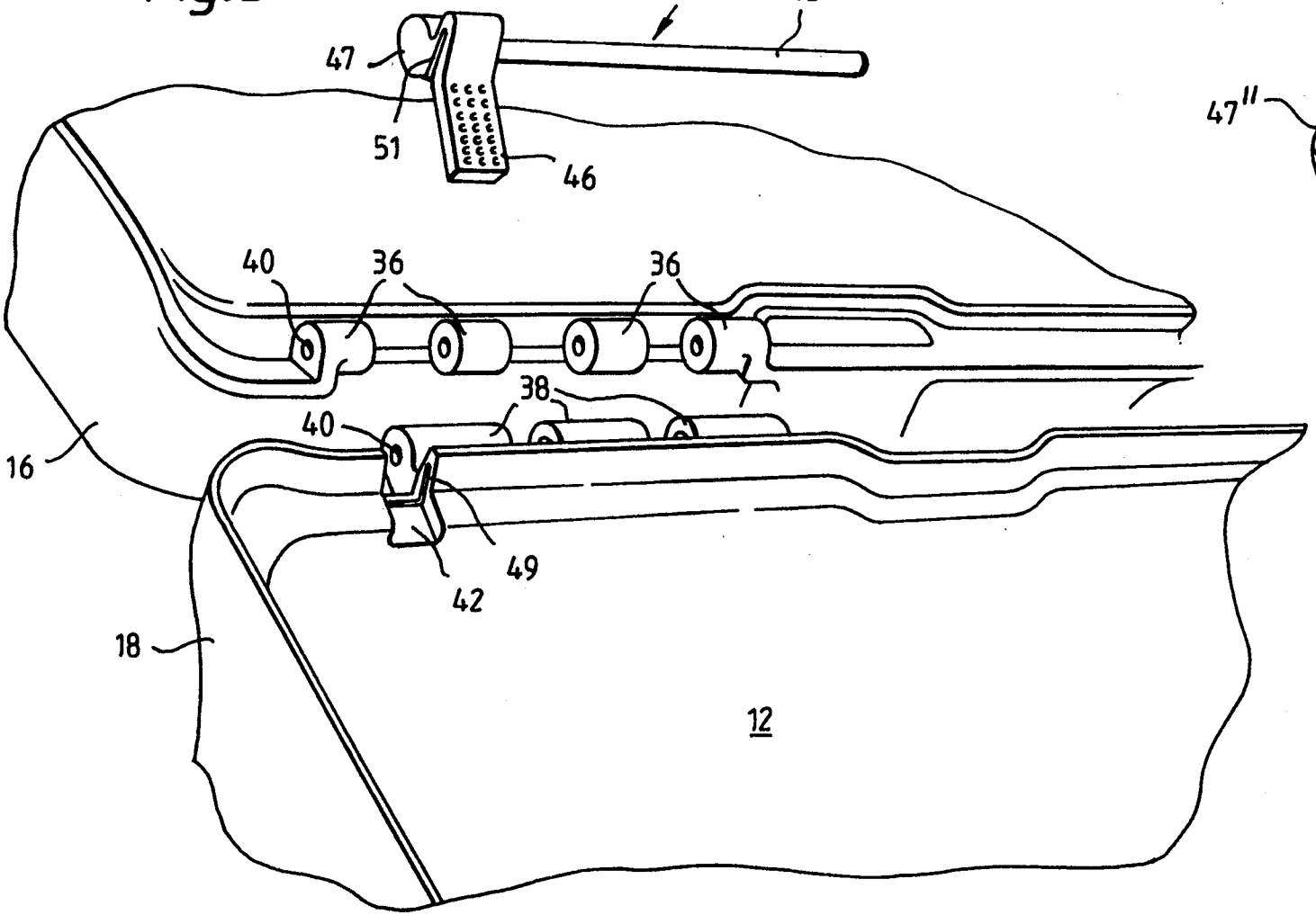
FIG. 3 shows an enlarged fragmentary view of a hinge of the case of FIGS. 1 and 2 with the parts separated.

Referring to FIGS. 2 and 3, the shells 12 and 14 are hinged together by three butt hinges **30*a*, 30*b* and 30*c* which are spaced apart along the bottom wall 22. Two hinges 30*a* and 30*c* are located near the corners of the bottom wall, and the other hinge 30*b*** is located at the middle of the bottom wall.

Figure 4:
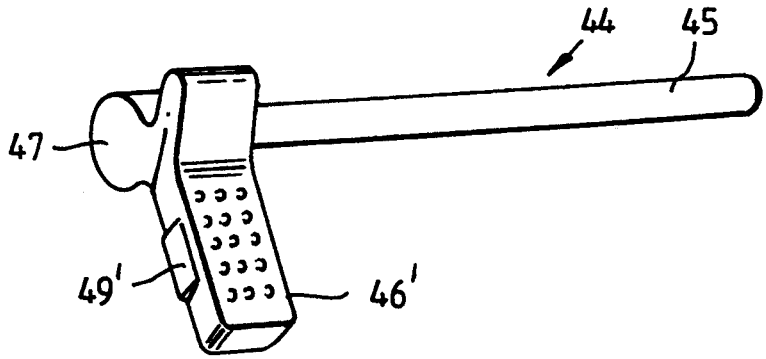
FIG. 4 shows a view similar to FIG. 3 of a modification of the hinge arrangement.
Figure 4:
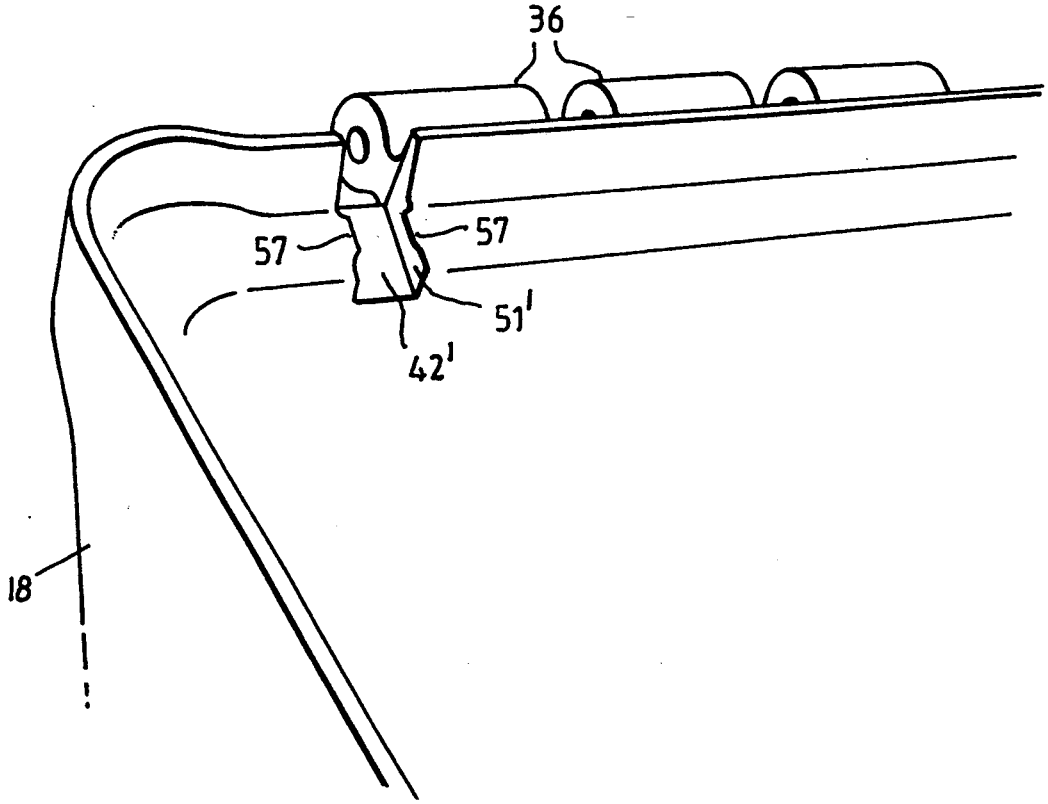
Figure 5:
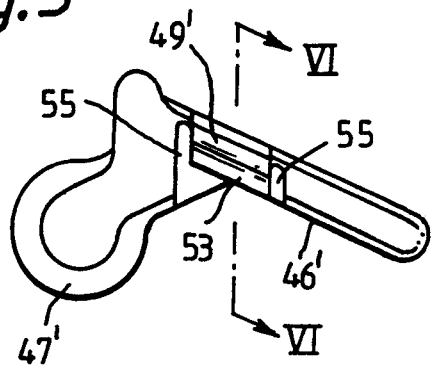
FIG. 5 shows a cross section through the hinge pin of FIG. 4.
Figure 6:
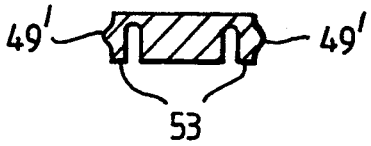
FIG. 6 shows a cross-section on the line VI—VI of FIG. 5.
Figure 7:
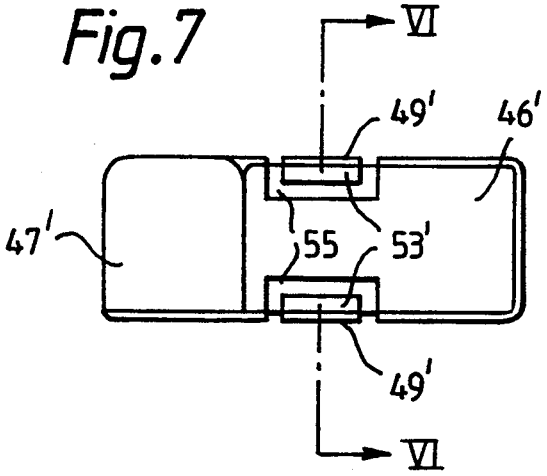
FIG. 7 shows an underneath plan view of the transverse portion of the hinge pin of FIGS. 4 to 6.

The hinge **30*a* is shown in more detail in FIG. 3 and 4. It comprises two sets of lugs or butts 36 and 38 integrally moulded on the edges of the peripheral side walls 16 and 18, respectively. The lugs in each set are spaced apart such that the set of lugs 36 fit the spaces between the lugs 38. A cylindrical bore 40 passes through each of the lugs 36 and 38. A slot 42 is formed in the peripheral wall of one of the shells, in this embodiment in the base shell 12, near one end of the hinge. The lugs 36 and 38 are secured together by an L-shaped hinge pin 44. The stem 45 of the pin 44 is inserted in the aligned bores 40, the transverse portion 46 of the pin 44 is rotated to locate the slot or recess 42 to lock the hinge pin 44 in position. The transverse portion forms a tight fit in the slot 42 so that the pin 44 will not become dislodged accidentally. To assemble the hinge, the shells 12 and 14 are arranged so that the lugs 36 and 38 on the shells are in register. The stem 45 of the hinge pin 44 is inserted into the end of the cylindrical bore 40 formed by the lugs, and pushed home. The end hub portion 47 of the pin adjacent the transverse portion is enlarged to serve as a stop to limit the extent to which the pin can be inserted into the bores and to make the hinge pin easier to grip. The pin 44 is gripped by the end 47 and the transverse portion 46 and pushed into the bore 40 by hand. Once the stem has been fully inserted, the pin 44 is rotated to locate the transverse portion 46 in the slot 42**.

As shown in FIG. 3, the slot 42 has a U-shaped ridge 49 lying in the plane of the peripheral wall 18 which co-operates with grooves 51 in the sides of the transverse portion 46 to locate the transverse portion in position in the slot 42. The transverse portion of the hinge pin is made of resilient plastics material as is the side wall of the case which allows the sides of the transverse portion to ride over the ridge until the grooves are positioned over the ridge. The entire pin including stem and transverse portion can be moulded of plastic material. Alternatively, the stem of the hinge pin may be formed of metal and the transverse portion formed of resilient plastics material.

The hinge is also designed so that it can be dismantled, for example, when the case is to be stored. To dismantle the hinge, the transverse portion 46 is pulled up out of the slot 42, and the pin 44 is then withdrawn from the bore 40 by using the transverse portion 46 as a handle on which to pull. The end 53 of the transverse portion projects inwards beyond the wall of the case so that it can be easily lifted out of the slot. Once the pin 44 has been extracted, the sets of lugs 36 and 38 can be separated.

The design of the slot 42 is such that the pin 44 cannot be removed from the hinge **30*a* unless the case is open. When the case is closed, the edge 29 of the lid shell wall 18 engages over the transverse portion 46 of the pin 44 thereby preventing it from being lifted out of the slot. The stem of the hinge pin 44 is therefore fixed axially within the cylindrical bore 40** of the hinge. This provides an added security feature in that, although the hinge is designed to be easily dismantled, the hinge parts cannot be separated unless the case has already been opened. The case is thus protected from a thief who might try to break into the case by removing the hinge pins.

FIGS. 4 to 7 show a modification of the hinge pin and locking arrangement of FIG. 3. In this arrangement the sides of the transverse portion 46' carry ridges or lugs 49' which co-operate with grooves or recesses 51' formed in the sides of the slot 42 to retain the transverse portion in the slot against accidental rotational displacement. The ridge 49' are carried on tabs 53' partially separated from the adjacent parts of the transverse portion 46′ by slots 55 so that they can flex more easily as the transverse portion is pushed into the slot 42 and the ridges 49′ ride past projections 57 which define the grooves or recesses 49′. In other respects the embodiment of FIGS. 4 to 7 is the same as that of FIG. 3 and the same reference numerals have been used.

Figure 8:
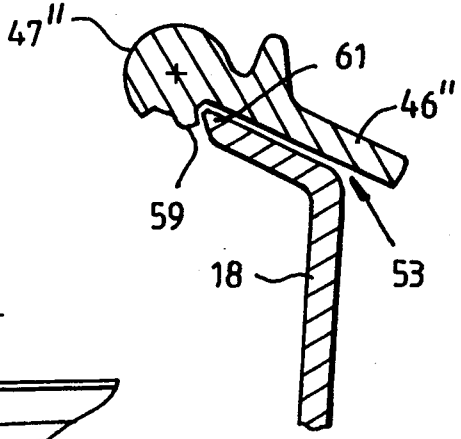
FIG. 8 shows a cross section similar to FIG. 5 of a further modification of the hinge arrangement.

FIG. 8 shows another modification of arrangement for holding hinge pin in the slot. In this arrangement a radial projection 59 is formed on the hub or barrel portion 47″ of the hinge pin. The radial projection 59 co-operates with the edge of the shell at 61 to act as retaining means for holding the transverse portion in the slot. As the pin is rotated in the clockwise direction as viewed in FIG. 8 about its axis the projection 59 rides over the edge 61 of the shell to pass from the inside to the outside, the resilient of the shell allowing the projection to pass. In the position shown in FIG. 8 the projection engages the outside edge of the shell to resist accidental movement of the transverse portion out of the slot but the resistant can be overcome when the transverse portion is deliberately pulled out of the slot.

Figures 9, 10:
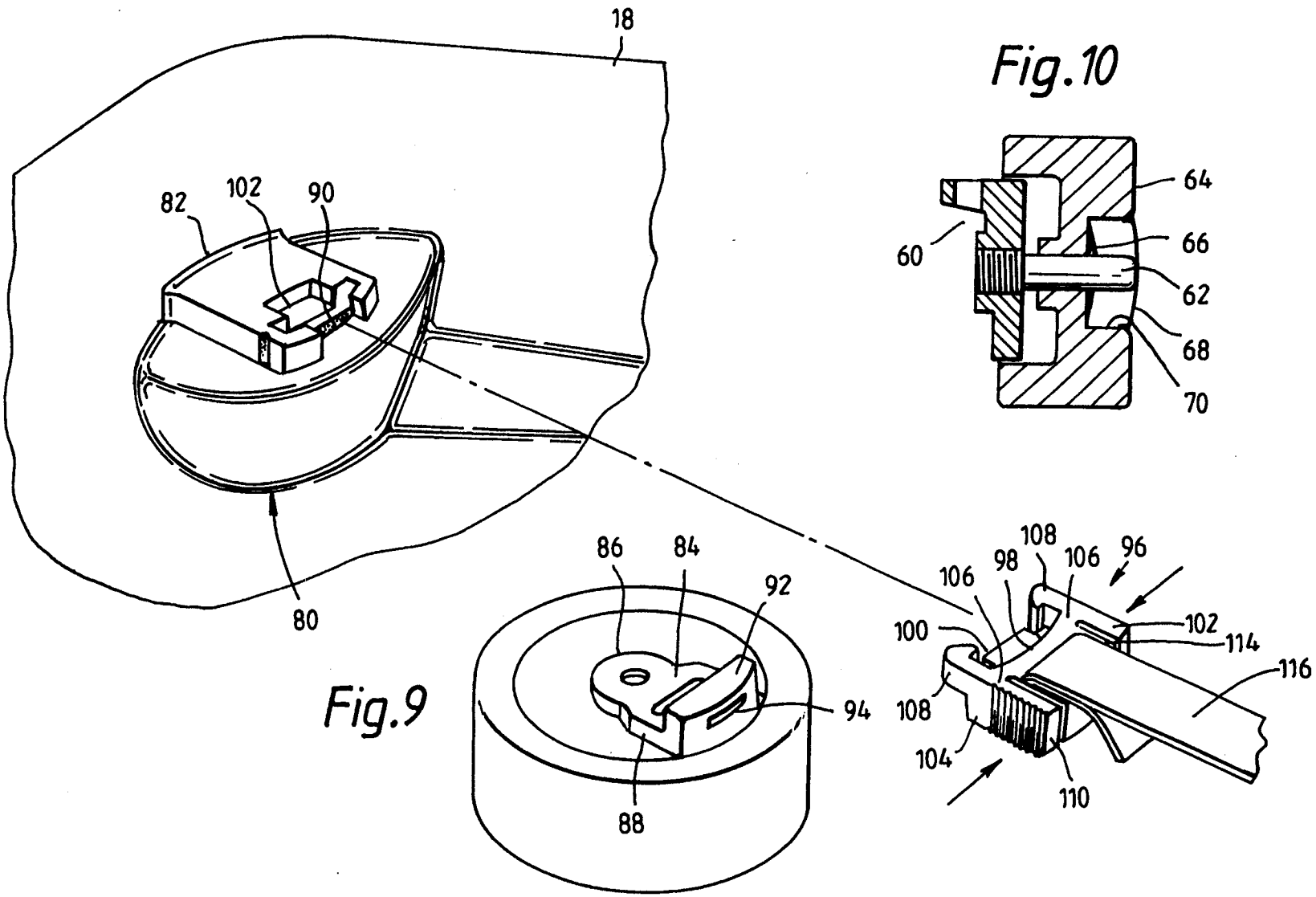
FIG. 9 shows an enlarged fragmentary view of an arrangement for mounting a wheel of the case of FIGS. 1 and 2.
FIG. 10 shows a cross-section through the wheel of FIG. 9.

FIG. 10 shows a cross section of one of the wheel assemblies of the case of FIGS. 1 and 2. The wheel assembly comprises a wheel mounting plate 60 which is moulded onto an axle 62. A wheel 64 is rotatable mounted on the axle 62 and retained by a star washer 66. A hub cap 68 is a friction fit in a recess 70 in the outer side of the wheel and provides a decorative finish to the wheel as well as keeping dirt out.

The wheel assembly is mounted in a re-entrant portion 80 of the shell at the corner between one of the end walls and the bottom wall. A non-circular, approximately key-hole shaped recess 82 is formed in the outside wall of the shell for receiving a correspondingly shaped raised portion 84 on the inside of the mounting plate. The raised portion includes a generally circular part 86 around the axle and a radially extending portion 88 which extends to the edge of the mounting plate.

The mounting plate is prevented from rotating with the wheel by the non-circular shape of the raised portion 84 of the recess 82 into which it fits.

An aperture 90 in the form of a slot extends through the wall of the shell in the region of the recess 82. A projection 92 extends inwardly of the case from the portion 88 of the mounting plate and is a close fit in the aperture 90. The inner end of the projection lies inside the case when assembled and has a transverse slot 94 passing through it. The slot tapers in thickness from the end nearer the rim of the wheel towards the end nearest the axle.

A clip 96 serves to retain the wheel assembly in position on the case. The clip includes a body portion 98 with a tongue 100 projecting from its forward end. The tongue tapers in thickness towards its free end. The tongue 100 fits the slot 94 in the wheel mounting 84. When the wheel mounting is positioned against the outside of the shell with the raised portion 84 in the recess 82 and the projection 92 extending through the aperture 90, the tongue 100 can be inserted into the slot 94 to retain the wheel assembly in position. The tapered or wedge shape of the tongue 100, like that of tongue 100′ shown in FIGS. 13, 14, 16 and 17, co-operates with the slot to pull the wheel mounting tightly into position. The body 98 of the clip 96 bears against the inside of the shell to take the reaction forces. There is an indention 102 on the inside of the shell on opposite sides of the slot to provide clearance for the tongue.

Along opposite sides of the clip are two generally parallel lever arms 104. The arms 104 are joined to the body 98 by integral hinge portions 106. At the forward ends of the levers are two inwardly facing opposing pawls 108.

The rear ends of the levers 104 are spaced from the body 96 and formed with gripping portions 110. The whole clip is formed as a single moulding from resilient plastics material. When the gripping portions 110 are squeezed together the lever arms pivot about the hinge portions 106 so that the pawls 108 move away from one another. When the gripping portions are released the pawls move inwards towards one another to resume their original positions.

The inside of the shell is formed with two notches 112 on opposite sides of the raised portion formed by the recess 82 on the outside of the case. When the tongue 100 is in the slot 94 the pawls 108 engage the notches 112 to retain the clip in position.

To release the clip the gripping portions 110 are squeezed together to release the pawls from the notches, thereby allowing the pawls to pass over the abutments formed by the sides of the notches and enabling the tongue to be withdrawn from the slot.

Figure 11:
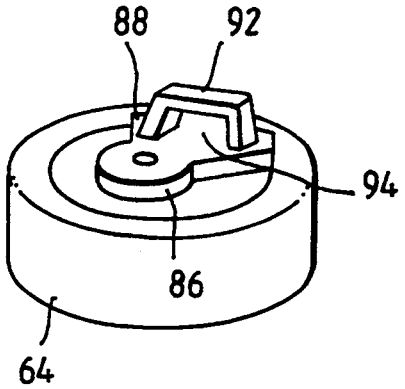
FIG. 11 shows a perspective view of the wheel of FIG. 9.
Figure 12:
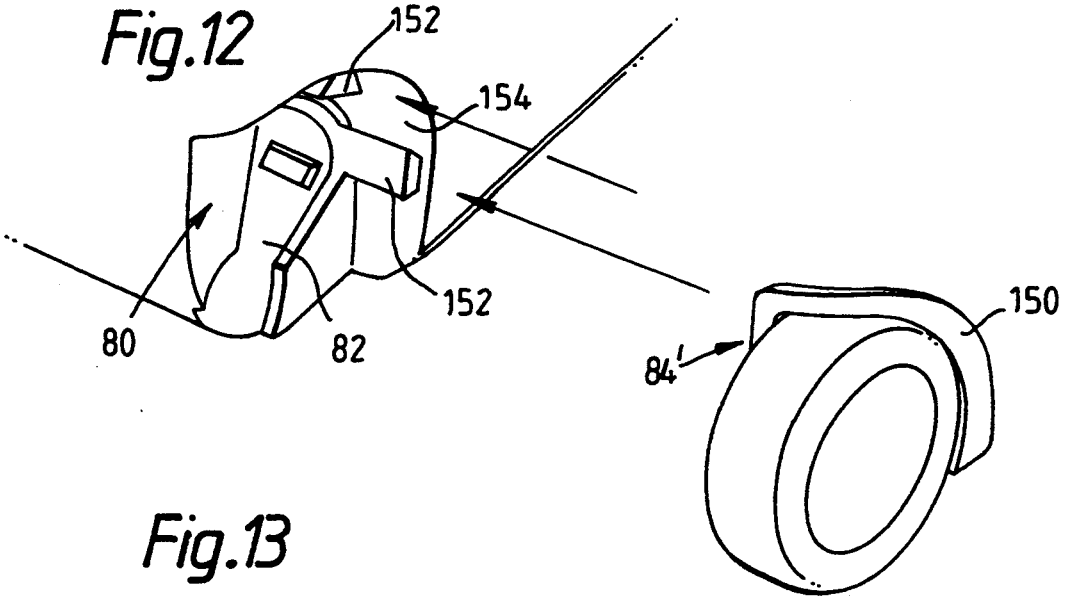
FIG. 12 shows a perspective view of an alternative arrangement for mounting a wheel with the parts separated.

The body 96 of the clip has three transverse slots 114 at its rear part through which one end of a strap 116 can be threaded. FIG. 12 shows a modification of the wheel mounting of FIGS. 9, 10 and 11. In this arrangement the mounting plate 84′ includes a shroud portion 150 which extends around part of the periphery of the wheel. The edges of the shroud portion engage two parallel dovetail shaped rails 152 formed on the arch 154 of the re-entrant portion 90. The rails co-operate with grooves (not shown) in the shroud to locate the shroud and hence the mounting plate in position. The mounting plate is, in other respects similar to the mounting plate 84 of FIG. 9 and held in position in a similar manner.

Figure 13:
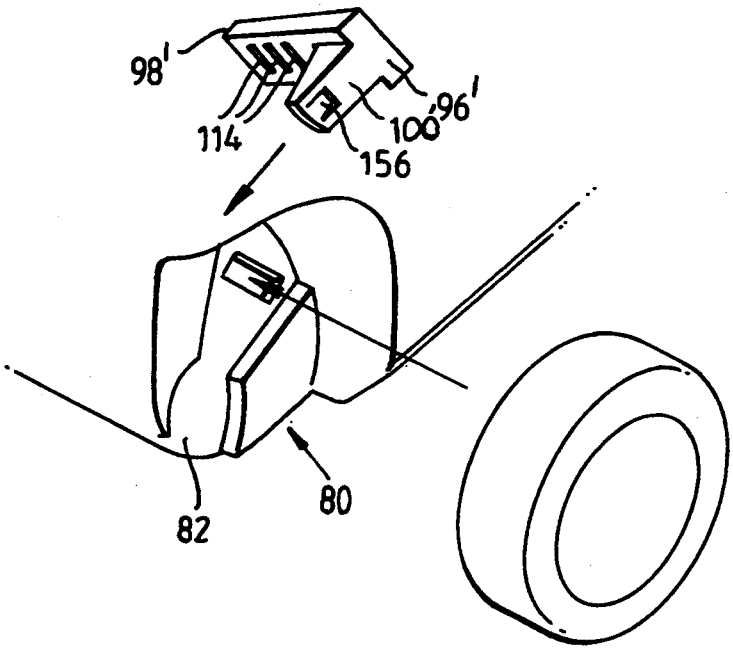
FIG. 13 shows yet another arrangement for mounting the wheel with the parts separated.
Figures 14, 15:
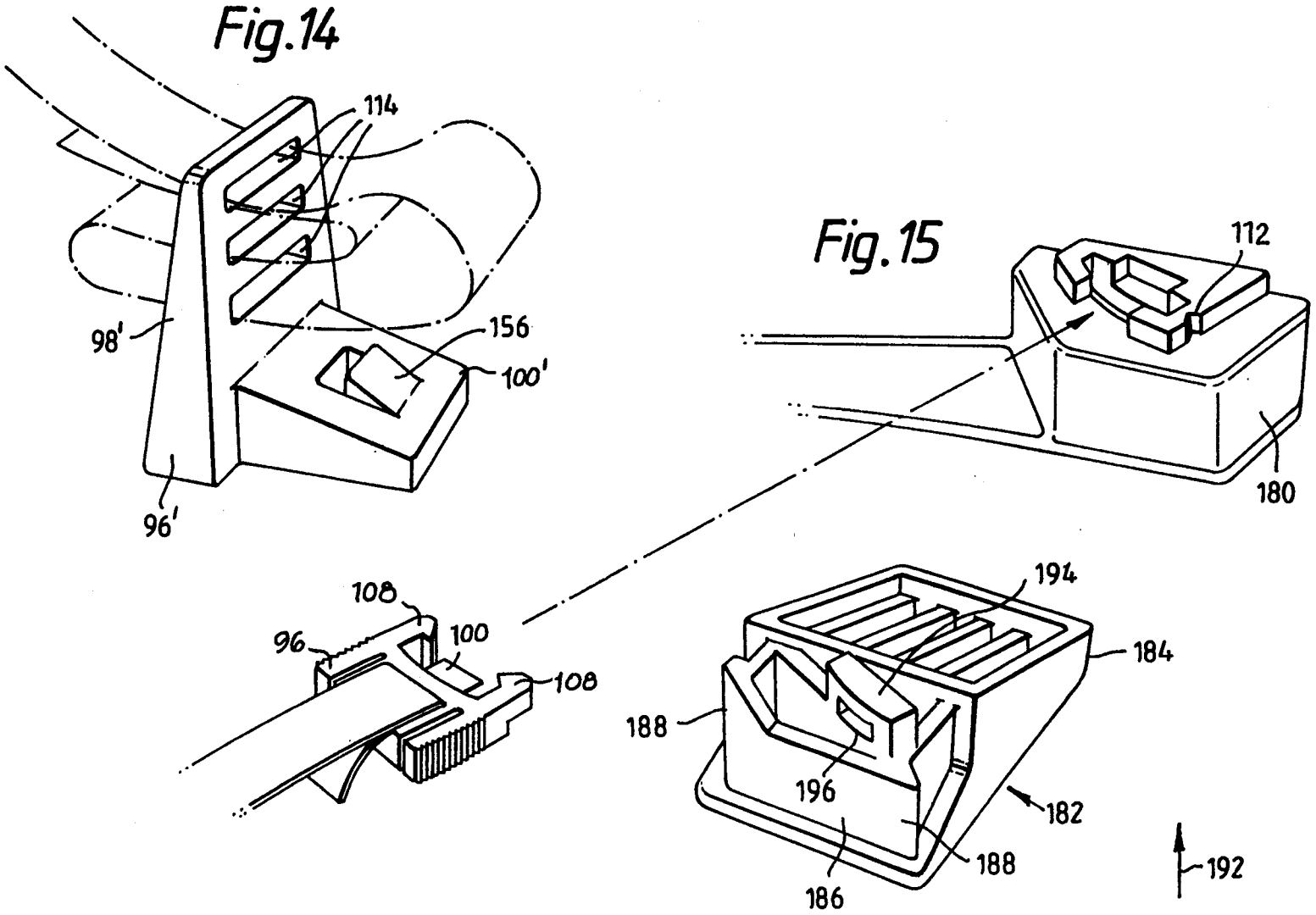
FIG. 14 shows an enlarged perspective view of the retaining clip for the wheel assembly of FIG. 13.
FIG. 15 shows a perspective view of an arrangement for mounting a foot of the case of FIGS. 1 and 2.

FIGS. 13 and 14 shows another modification of the arrangement for retaining the wheel assembly in position. In this arrangement the clip 96′ has a tongue 100′ extending at an angle to the plane of the body 98′. The tongue is wedge-shaped and has a resilient tang 156 projecting upwardly from its upper inner surface and inclined toward the body of the clip. As the tongue 100′ is inserted through the slot 94 in the projection 92 the tang is deflected into the tongue to allow the tongue to pass through. Once the tang 156 has passed through the slot 94, the rearwardly facing edge of the tang 156 can spring up to engage the side of the projection 92 alongside the slot and retain the clip in position. To remove the clip the tang 156 is pressed down into the tongue 100′ so that the tongue can be pulled out of the slot 94.

In other respects, the wheel mounting arrangement of FIG. 12 can be similar to that of FIG. 9.

FIG. 15 shows an arrangement for mounting a foot to the case of FIGS. 1 and 2. Near the corner of the shell between the bottom wall and the end wall opposite the end wall where the wheel is located, is a recess 180 in the outside of the shell.

A foot 182 has a ground engaging portion 184 and a mounting portion 186. The mounting portion includes two parallel key portions 188 which co-operate with corresponding grooves at the sides of the recess 180 so that the foot can be slid in the direction of the arrow 192 into the recess. The flange 194 formed around the edge of the mounting portion abuts the outside of the shell to where the mounting portion is pushed fully home.

The mounting portion 186 includes a projection 194 with a transverse slot 196 similar to the projection 92 and slot 94 of the wheel mounting arrangements.

The base of the recess 180 has an aperture 198 in the form of a slot which allows the projection 194 to pass from outside to the inside of the shell. The foot is retained in position by a clip 96 identical to the clip 96 of FIG. 9. The retaining of the foot is similar to the retaining of the wheel assembly of FIG. 9 and corresponding parts have been given the same numerals.

Figure 16:
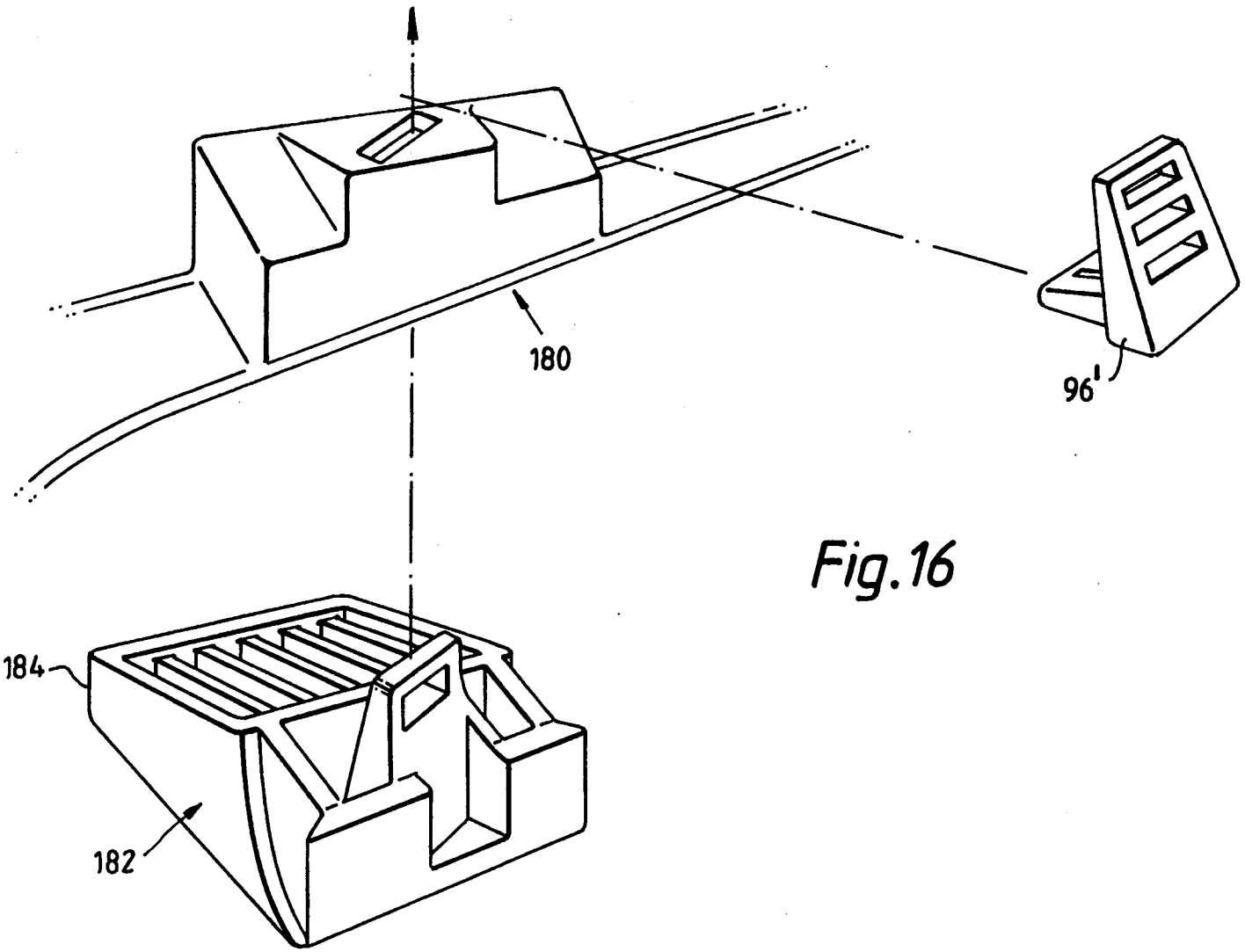
FIG. 16 shows a perspective view of an alternative arrangement for mounting a foot on the case of FIGS. 1 and 2.

FIG. 16 shows a modification of the arrangement for retaining the foot in which a clip 96' identical to 96 of FIGS. 13 and 14 is used. In other respects the foot mounting is the same as that of FIG. 15.

Figure 17:
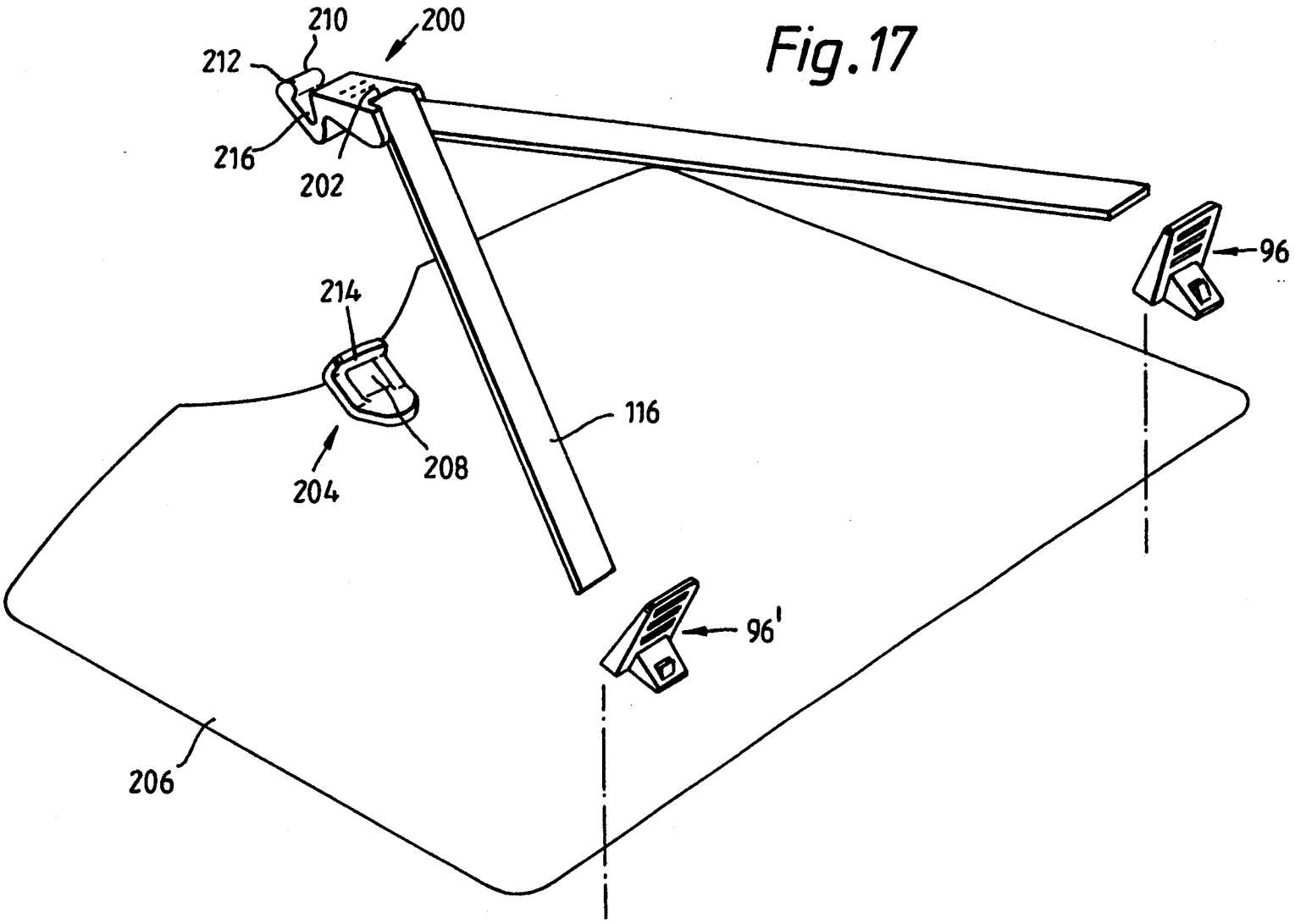
FIG. 17 shows a perspective view of an internal retaining strap for the case of FIG. 1 and 2.

FIG. 17 is a schematic view of the strap 116 with its anchorage means. Clips 96' are attached to opposite ends of the strap 116 and anchored to the wheel mounting and the foot mounting respectively as shown in FIGS. 9 and 15 or 13 and 16, depending on the type of clip used. A third clip 200 is attached to the strap intermediate its ends. The clip 200 has a slot 202 through which the clip passes.

A bracket 204 is attached to the inside of the shell of the suitcase or, as shown, to a dividing panel 206 within the suitcase. The bracket has an opening 208 through which a hook-shaped portion 210 of the clip 200 can be passed. The hook portion 210 has a lip 212 which rests on a bar portion 214 of bracket 204.

The clip 200 has a channel 216 immediately below the hook portion for receiving the hooks on coat hangers so that when garments on hangers are placed under the strap 116 the hooks on the hangers can be placed in the channel 216 and thus retained in position.

A suitcase as described above may have two wheels and two feet. Only one of the wheels and one of the feet may be secured to the case with clips attached to a strap. The other wheel and foot may be secured by similar clips without any strap attached to them.

It is to be noted that in the embodiments described above the axis of the aperture 90, 198 through which the projection 92, 194 on the mounting portion on the wheel or foot extends, is perpendicular to the major side wall 17, 19 of the case. The re-entrant portions 80, 180 of the shell and the recesses 82 for receiving the mounting portions of the wheel assemblies and feet also face outwardly along this axis so as to present no undercuts. In this way the apertures, re-entrant portions and recesses can be formed by moulding with the same tool that forms the main shells, without a need for separate inserts.

The suitcase described above may be easily assembled from a kit of parts comprising lid and base shells, hinge pins two wheel assemblies and two feet, four retaining clips and a strap. The two shells may be storage nested one inside the other. To assemble the case the hinge butts of lid and base shells are aligned and the hinge pins are inserted. Clips are threaded onto the ends of the strap and one wheel assembly and one foot are mounted in their recesses in the outside of the base shell using these clips. The remaining wheel assembly and foot are then mounted on the lid of the case using the remaining clips. The case is then ready for use. The case may be disassembled by reversing the process.

The case described can thus be assembled for use and dismantled for storage without the use of tools.

Although in the embodiments described above the mounting in accordance with the invention is described only in relation to mounting the wheels and feet of the case, it will be appreciated that the mounting could be adapted for handles or pulling loops in accordance with the invention.

I claim:

1. A luggage case comprising two shells, hinged together, an external fitting, and retaining means which includes manually releasable latching means, the external fitting including a mounting portion adapted to fit against a corresponding mounting portion of one of the shells, the corresponding mounting portion of one of the shells including an aperture through the wall of the shell, and the mounting portion of the external fitting including a projection which extends through the aperture in the wall of the case to the inside of the case, and the manually releasable latching means operated from within the luggage case to releasably engage the part of the projection which is inside the shell to retain the mounting portion of the external fitting in position, the luggage case further. including a strap for securing luggage inside the case, the retaining means comprising means for anchoring the strap to the inside of the shell of the case.

2. A luggage case according to claim 1 in which the retaining means includes slots for attachment of the strap.

3. A luggage case according to claim 2 in which the recess is of non-circular outline.

4. A luggage case according to claim 1 in which the projection has a transverse opening which receives a portion of the retaining means when the manually releasable latching means is operated by hand from within the case.

5. A luggage case according to claim 4 in which the retaining means includes a tongue which passes through the opening in the projection to retain the mounting portion of the ground-engaging means in position against the outside of the wall of the shell.

6. A luggage case according to claim 5 in which the tongue is wedge-shaped.

7. A luggage case according claim 1 in which the manually releasable latching means engage abutments on the inside of the shell to hold the retaining means in position.

8. A luggage case according to claim 7 in which the manually releasable latching means comprise two resilient pawls.

9. A luggage case according to claim 8 in which the pawls engage notches formed on the inside of the case.

10. A luggage case according to claim 10 in which the pawls are mounted on two lever arms which are pivotally mounted intermediate their ends, the lever arms including gripping portions on opposite ends to the pawls, the pawl ends of the arms being biased toward one another, the pawls being moved away from one another so as to disengage the abutments when the gripping portions of the lever arms are squeezed together.

11. A luggage case according to claim 1 in which the shell includes a peripheral wall surrounding a major wall, the fitting is mounted in a reentrant portion on the outside of the shell which faces outwardly along the axis perpendicular to the plane of the major wall and presents no significant undercuts in this direction.

12. A luggage ease according to claim 1 in which the external fitting comprises ground engaging means.

13. A luggage case according to claim 12 in which the external fitting is a wheel mounted on an axle which in turn is mounted in a cantilever manner from the mounting portion.

14. A luggage case according to claim 13 in which the axis of the wheel extends generally parallel to the axis of the aperture.

15. A luggage case comprising two shells, hinged together, an external fitting, and retaining means which includes manually releasable latching means, the external fitting including a mounting portion adapted to fit against a corresponding mounting portion of one of the shells, the corresponding mounting portion of one of the shells including an aperture through the wall of the shell, and the mounting portion of the external fitting including a projection which extends through the aperture in the wall of the case to the inside of the case, and the manually releasable latching means operated from within the luggage case to releasably engage the part of the projection which is inside the shell to retain the mounting portion of the external fitting in position, in which the projection includes a slot, and the retaining means includes a portion which co-operates with the slot to prevent the projection from being withdrawn through the aperture, and co-operating portion of the retaining means being wedge shaped and the co-operating portion of the slot being shaped such that the fitting is progressively pulled more tightly against the shell as the retaining means is inserted into the slot in the projection.

16. A luggage case according to claim 15 in which the manually releasable retaining means includes a manually-releasable resiliently mounted detent, catch or pawl for holding the retaining means in position.

* * * * *